United States Patent [19]

Ferguson et al.

[11] Patent Number: 4,583,581

[45] Date of Patent: Apr. 22, 1986

[54] CORE MATERIAL AND METHOD OF FORMING CORES

[75] Inventors: Thomas A. Ferguson, Parma; Duane Dierschow, Willoughby; Robert F. Hauser, North Olmsted, all of Ohio

[73] Assignee: TRW Inc., Cleveland, Ohio

[21] Appl. No.: 611,429

[22] Filed: May 17, 1984

[51] Int. Cl.[4] ..... B22C 1/02

[52] U.S. Cl. ..... 164/529; 164/519; 164/369; 106/38.9

[58] Field of Search ..... 164/518, 519, 529, 369; 106/38.9

[56] References Cited

U.S. PATENT DOCUMENTS 4,093,017 6/1978 Miller, Jr. et al. .
4,128,431 12/1978 Svec .
4,188,450 2/1980 Greskovich .
4,190,450 2/1980 Robb et al. .
4,236,568 12/1980 Larson .

FOREIGN PATENT DOCUMENTS 12040 6/1980 European Pat. Off. ..... 164/529

*Primary Examiner*—Kuang Y. Lin
*Attorney, Agent, or Firm*—Yount & Tarolli

[57] ABSTRACT

An improved core material is used in an improved method of forming cores for investment casting of articles. The core material comprises fused silica, synthetic amorphous silica, a refractory material, and a binder. The synthetic amorphous silica has a surface area of at least 200 square meters per gram. Even though the synthetic amorphous silica has a relatively large surface area, it has a particle size of less than 10 microns and is 5% or less by weight of the total weight of the solid constituents of the core material slurry. After a green core has been formed in a core mold it is fired to set the core material. During firing, the green core shrinks in size. To compensate for deviations in the size of a finished core from a desired size, the percentage of synthetic amorphous silica in the core material slurry is varied.

9 Claims, 2 Drawing Figures

CORE MATERIAL AND METHOD OF FORMING CORES

BACKGROUND OF THE INVENTION

The present invention relates to a new and improved core material and a method of forming cores to be used in investment casting of an article, such as an airfoil.

When the investment casting of an airfoil is to be undertaken, a wax pattern is formed around a core. To form a wax pattern, the core is placed in a pattern mold cavity. The pattern mold cavity has a configuration which corresponds to the configuration of the airfoil to be cast. Wax is then injected into the pattern mold cavity. This wax surrounds the core to form the wax pattern.

After the pattern has been removed from the mold, the pattern is covered with ceramic mold material. After the ceramic mold material has been at least partially set, the wax material is removed by heating the mold. This leaves a mold cavity having a configuration corresponding to the configuration of the airfoil to be cast. The ceramic mold material holds the core in a position in the mold cavity corresponding to the desired location of internal passages in the airfoil to be cast.

Molten metal is then poured into the mold cavity. The molten metal solidifies to form the airfoil. After the molten metal solidifies, the airfoil is removed from the mold and the core material is removed from the inside of the airfoil. This leaves passages inside the airfoil to conduct cooling fluid flow.

To form a core, a green core is made by injecting a slurry of core material into a core mold. The green core is then removed from the core mold and subjected to two firings. After the first firing, the core is coated with a ceramic binder and is then subjected to a second firing.

In order to minimize breakage, the core must be relatively strong after the first firing. In order to form airfoil passages with smooth inside surfaces, the core must have a smooth outer side surface. In addition, the core must be made of an inert material which does not react with the nickel-chrome superalloys from which airfoils are commonly formed.

Cores for use in investment casting have previously been formed from a slurry containing fused silica, zircon and a binder. This slurry must be injected into very small spaces in a core mold. The small spaces in the core mold are required in order to enable the core to form small passages in an airfoil. The small spaces in the mold must be completely filled with the slurry of core material in order to provide a core having a desired configuration. Therefore, the slurry of core material must have a high degree of flowability. However, the amount of liquid constituents in the slurry must be limited so that the core will have a desired density and strength.

During the firing of the core materials, liquid components in the slurry are driven off. This results in shrinkage of the core from the size to which it is formed in the core mold. This shrinkage must be controlled and accurately predicted in order to maintain the required core dimensional tolerances. Thus, core tolerance ranges on the order of $\pm 0.005$ of an inch over a length of five inches are necessary for certain cores. The achieving of this accuracy requires the accurate control of shrinkage during firing of the core.

SUMMARY OF THE INVENTION

The present invention relates to a new and improved material for use in forming cores and to a method of accurately forming cores to desired dimensions. An improved core material includes a synthetic amorphous silica having a surface area of at least 200 square meters per gram. The synthetic amorphous silica has a particle size which is less than 10 microns. Although the synthetic amorphous silica comprises 5% or less by weight of the total solid constituents of the core material, the synthetic amorphous silica enhances the flowability of the core material so that it will fill very small passages in a core mold. In addition, the synthetic amorphous silica enhances the strength of the core after a first firing to reduce core breakage during handling of the core between firings.

The synthetic amorphous silica also enables core shrinkage to be more easily controlled. Thus, if the core does not have the desired dimensions due to shrinkage during firing of the core, the amount of synthetic amorphous silica in the core material slurry can be varied to vary the amount of shrinkage and thereby obtain the desired core size. Due to the large amount of surface area on the synthetic amorphous silica, relatively small changes in the amount of synthetic amorphous silica causes substantial changes in core shrinkage. The amount of core shrinkage increases directly with increasing percentages of synthetic amorphous silica in the core material slurry.

Accordingly, it is an object of this invention to provide a new and improved material for use in forming cores and wherein the material includes a synthetic amorphous silica having a surface area of at least 200 square meters per gram.

Another object of this invention is to provide a new and improved method of forming cores of a predetermined size and configuration and wherein the method includes compensating for deviations in the size of a core from a desired size by varying the percentage of the synthetic amorphous silica in a core material.

BRIEF DESCRIPTION OF THE DRAWINGS

The foregoing and other objects and features of the present invention will become more apparent upon a consideration of the following description taken in connection with the accompanying drawings wherein.

DESCRIPTION OF A SPECIFIC PREFERRED EMBODIMENT OF THE INVENTION

Figure 1:
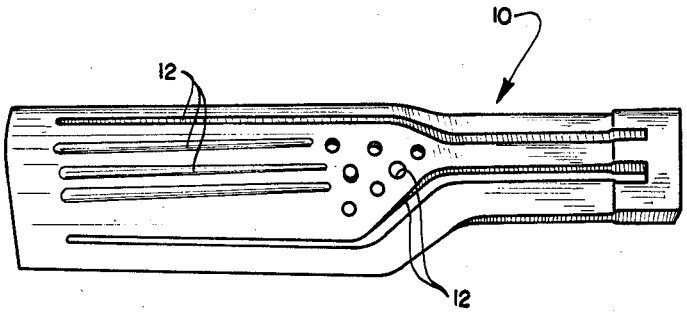
FIG. 1 is an illustration of a core for use in investment casting of an airfoil.

A ceramic core 10 (FIG. 1) is used for the investment casting of a hollow airfoil. The core 10 has a configuration corresponding to the configuration of passages to be formed inside the airfoil. During operation of an engine, fluid flow is conducted through the passages in the airfoil to cool the airfoil in a known manner.

When the core 10 is to be used during the investment casting of a hollow airfoil, the core is placed in a pattern mold cavity having a configuration which corresponds to the configuration of the airfoil to be cast. Wax is then injected into the pattern mold cavity. The wax surrounds the core 10 and fills the small openings 12 in the core.

The wax pattern is then removed from the pattern mold and is covered with a ceramic mold material. After the ceramic mold material has at least partially hardened, the wax is removed from inside the mold material. This leaves the core 10 accurately positioned in a mold cavity having a configuration corresponding to the configuration of the airfoil to be cast. Molten metal is then poured into the mold cavity. This molten metal surrounds the core 10. After the molten metal solidifies to form an airfoil, the airfoil is removed from the mold and the core 10 is removed from the inside of the airfoil.

The core 10 must be strong enough to withstand handling. Thus, the core 10 must have sufficient green strength to enable it to be removed from a core mold after it has been shaped to a desired configuration and prior to firing of the core. The green core may be subjected to two firings. Between the two firings, the core 10 is covered with a ceramic binder. Therefore, after the first firing, the core must have sufficient strength to enable it to be handled without breakage.

In order to form smooth passages in the airfoil, the core 10 must have a smooth outer side surface. In addition, the formation of smooth passages inside the airfoil and the formation of a strong airfoil is promoted by having the core 10 formed of a material which does not react with the nickel-chrome superalloys commonly used to form the airfoils. In addition, in order to prevent the forming of hot tear defects in the freshly cast airfoil, the core material must fail preferentially to the airfoil. It should be understood that the core 10 has a generally known configuration which is similar to the core configuration disclosed in U.S. Pat. No. 4,093,017. However, the core material and method of the present invention could be used to form many different types of cores other than the specific core 10 illustrated in FIG. 1.

The core 10 is formed from a slurry of core material. The slurry of core material is formed by mixing (see FIG. 2) fused silica, synthetic amorphous silica, refractory material, and a binder. Although the fused silica, synthetic amorphous silica and refractory material form the major solid constituents of the core material slurry, other known solid constituents could be included in the core material slurry if desired.

The fused silica has a particle size of about 80 microns and comprises between approximately 61% and 66% by weight of the total solid constituents of the core material slurry. The synthetic amorphous silica has a particle size of less than 10 microns and forms between 5% and 0.25% by weight of the solid constituents of the core material slurry. The refractory material may be a zircon flour having an average mean particle size of about 10 microns and forms about 33% by weight of the total weight of the solid constituents of the core material slurry. Although it is preferred to use zircon as a refractory material, it is contemplated that magnesite, chromite or graphite may be used as all or part of the refractory material.

A liquid binder is mixed with the aforementioned solid constituents to interconnect them and form a unitary core. Although it is preferred to use hydrolized ethyl silicate as a binder, the binder could be polyethylene, polypropylene, a wax, or other known binder materials. It is preferred to use between 7 and 11 milliliters of liquid binder for each ounce of solid material constituent in the core material slurry.

In accordance with a feature of the present invention, the synthetic amorphous silica has a surface area of at least 200 square meters per gram. The relatively large surface area of the synthetic amorphous silica provides a large area for contact with the binder solution. In addition, the synthetic amorphous silica is present as aggregates of smaller spherical particles which may promote the flowability of the core material by shearing of the aggregates in much the same manner as graphite acts as a dry lubricant.

After a green core, formed of a core material slurry having the foregoing composition, is fired for a first time, the core has a relatively high strength. A core containing synthetic amorphous silica having a surface area of greater than 200 square meters per gram will have a first firing strength which is almost twice as great as the first firing strength of a core formed of a similar material without the high surface area synthetic amorphous silica.

In one specific instance, a core was formed from a slurry in which synthetic amorphous silica having a surface area of 310 square meters per gram was approximately 5% by weight of the solid constituents, zircon was approximately 33% by weight of the solid constituents and fused silica was approximately 62% by weight of the solid constituents. This core had a modulus of rupture after a first firing of 570 pounds per square inch. A second core formed of the same material, except for the synthetic amorphous silica, had a modulus of rupture after a first firing of only 289 pounds per square inch. After a second firing, the core containing 5% synthetic amorphous silica with a surface area of greater than 200 square meters per gram had a modulus of rupture of 1,064 pounds per square inch, the second core, which did not contain synthetic amorphous silica, had a modulus of rupture of of 1,083 pounds per square inch.

The relatively high first fire strength of the core containing synthetic amorphous silica having a surface area of greater than 200 square meters per gram enabled the core to be handled between firings with a minimum of breakage. Thus, after the first firing it is a common practice to coat the core with a ceramic binder and then subject the core to a second firing. The relatively high first firing strength of the core containing the synthetic amorphous silica enabled it to be handled during the application of a binder with a minimum possibility of breakage. Since the second fire strength of both cores, that is the core containing the synthetic amorphous silica and the core which did not contain the synthetic amorphous silica, are approximately the same, both cores would tend to fail preferentially to the casting when subjected to approximately the same stress.

A synthetic amorphous silica having a surface area of greater than 200 square meters per gram is made by mixing predetermined concentrations of an acid and a soluble silicate, and allowing the mixture, known as hydrosol, to set to a gel-like mass called hydrogel. After setting, the hydrogel is broken into small lumps and thoroughly washed to remove the acids and salts resulting from the reaction. The washed hydrogel is then dried and sized to developed controlled particle sizes.

Although many different types of synthetic amorphous silicas could be used, it is presently preferred to use a commercially available synthetic amorphous silica sold by the Davison Chemical Division of W. R. Grace & Co. under the trademark Syloid. The synthetic amorphous silicas sold by the Davison Chemical Division of W. R. Grace & Co. under the trademark Syloid with characteristics suitable for use as a synthetic amorphous silica in the core material slurry of FIG. 2, have the following ranges of physical and chemical characteristics:

| Characteristics | Percentages |
|---|---|
| Loss on ignition at 1750° F. (%) | 5–15.5 |
| pH (5% slurry in $H_2O$) | 3–7 |
| $SiO_2$ (%, ignited basis) | 96.6–99.7 |
| Avg. particle size (microns) | 2.5–9.0 |
| Surface area ($m^2/g$) | 250–675 |
| Bulk density (lb./ft.$^3$) | 7–29 |
| Bulking value (lb./gal.) | 16.66 |
| Soluble salts (%) | 0.08–0.5 |
| Pore Volume (cc/gm) | 0.4–1.7 |

At the present time it is preferred to use the synthetic amorphous silica sold by the Davis Chemical Division of W. R. Grace Company under the trademark Syloid 244. Syloid 244 has the following physical and chemical characteristics:

| Characteristics | Percentages |
|---|---|
| Loss on ignition at 1750° F. (%) | 8.5 |
| pH (5% slurry in $H_2O$) | 7.0 |
| $SiO_2$ (%, ignited basis) | 99.4 |
| Avg. particle size (microns) | 3.0 |
| Surface area ($m^2/g$) | 310.0 |
| Bulk density (lb./ft.$^3$) | 8.0 |
| Bulking value (lb./gal.) | 16.66 |
| Soluble salts (%) | 0.2 |
| Pore Volume (cc/gm) | 1.4 |

The Syloid silicas sold by Davison Chemical Division of W. R. Grace & Co. under the trademark Syloid have the following typical chemical analysis:

| Chemical | Percentages |
|---|---|
| Silicon dioxide | 99.60 |
| Aluminum as $Al_2O_3$ | .06 |
| Titanium as $TiO_2$ | .03 |
| Calcium as CaO | .08 |
| Sodium as $Na_2O$ | .10 |
| Magnesium as MgO | .05 |
| Trace elements as oxide | .02 |
| Arsenic | Less than 3 ppm |
| Lead | Less than 10 ppm |
| Heavy metals | Less than 30 ppm |

Although it is preferred to use the synthetic amorphous silica sold by Davison Chemical Division of W. R. Grace & Co. under the trademark Syloid 244, it is contemplated that other known synthetic amorphous silicas could be used if desired. However, these other known synthetic amorphous silicas should have a particle size which is less than 10 microns and a surface area which is greater than 200 square meters per gram.

Figure 2:
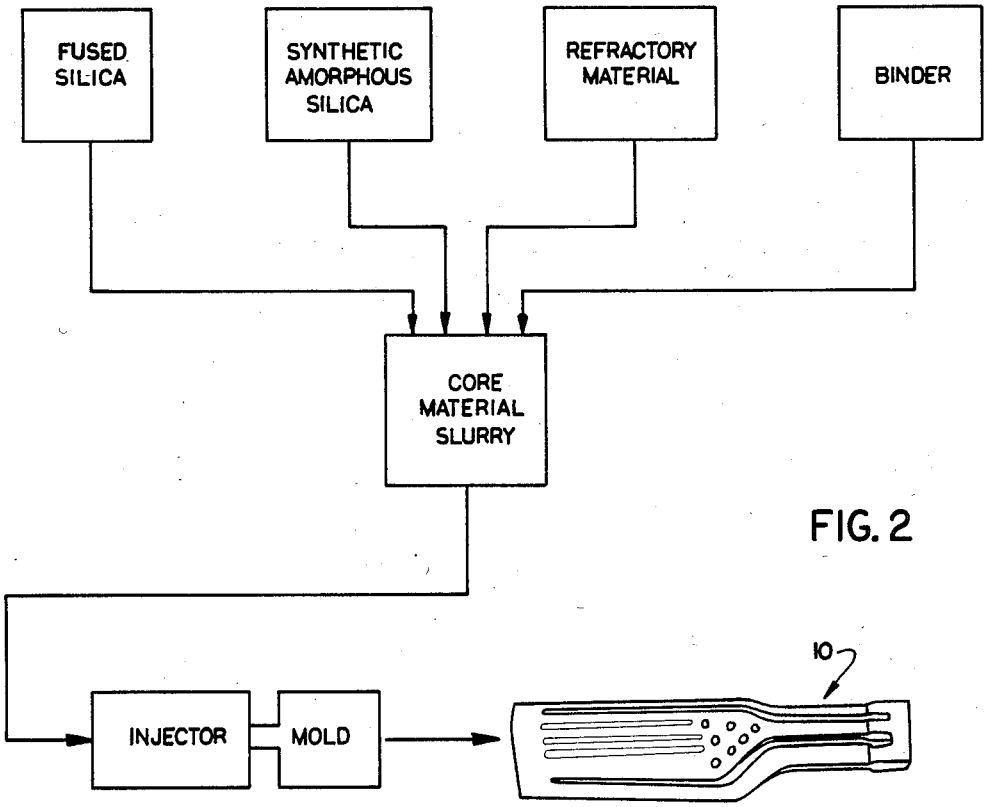
FIG. 2 is a schematic illustration of the manner in which the core of FIG. 1 is formed.

When a core is to be formed, fused silica, synthetic amorphous silica, a refractory material and a binder are mixed to form a core material slurry in the manner indicated schematically in FIG. 2. The synthetic amorphous silica is preferably Syloid 244 and forms 1% by weight of the total weight of solid constituents in the core material slurry. The refractory material is preferably zircon and is 33.3% by weight of the total weight of the solid constituents of the core material slurry. The remaining solid constituent is fused silica. The binder is hydrolized ethyl silicate. Approximately 10 millimeters of binder is used for every ounce of solid constituents in the core material slurry.

The core material slurry is injected into a core mold in a known manner. The core mold shapes the slurry to form a green core. The synthetic amorphous silica promotes the flowability of the core material slurry into small passages formed in the mold. The green core is then removed from the mold and subjected to two firings.

After the first firing, the core will have a modulus of rupture of approximately 570 pounds per square inch. The once fired core is then dipped in a ceramic binder and fired for a second time. After the second firing, the core has a modulus of rupture of approximately 1064 pounds per square inch. During firing of the green core, it shrinks in size. Therefore, the resulting core will have a size which is different, due to shrinkage, than the size of the cavity in the core mold.

After the core has been twice fired, it is measured to determine whether or not its dimensions correspond to the desired core dimensions. The first time a particular core is made, it will probably be larger or smaller than the desired size due to shrinkage during firing being more or less than the predicted shrinkage. Thus, a core formed from a core material slurry containing synthetic amorphous silica having a surface area of more than 200 square meters per gram in a quantity of 5% by weight of the total weight of the solid constituents of the core material slurry will probably have a shrinkage of approximately 2.0 percent during firing. A core formed of a similar core material slurry without synthetic amorphous silica will probably have approximately 0.2 percent shrinkage during firing.

After the core has been measured and it is determined whether the core is undersized or oversized, the deviation in the size of the core from the desired size is compensated for by varying the percentage of synthetic amorphous silica in the core material slurry. Thus, if the twice fired core is oversized, the percentage of synthetic amorphous silica in the core material slurry will be increased to increase the amount of shrinkage during firing. Similarly, when the core is undersized due to excessive shrinking, the percentage of synthetic amorphous silica in the core material slurry is reduced. Due to the large surface area of the synthetic amorphous silica, a small change in the amount of synthetic amorphous silica has a substantial change on the extent of core shrinkage.

After the percentage of synthetic amorphous silica in the core material slurry has been varied to compensate for deviations in the size of a first fired core, the core material slurry is injected into a mold to form a second core. The second green core is subjected to a first firing, coated with a ceramic binder after a first firing, and subjected to a second firing. After the second green core has been twice fired, it is measured to determined to the extent to which its size deviates from the desired core size. If the size of the second green core deviates from the desired core size, the percentage of synthetic amorphous silica in the core material slurry is again varied to compensate for the deviation in core size.

In view of the foregoing it is apparent that the present invention relates to a new and improved material for use in forming cores and to a method of accurately forming cores to desired dimensions. An improved core material includes a synthetic amorphous silica having a surface area of at least 200 square meters per gram. The synthetic amorphous silica has a particle size which is less than 10 microns. Although the synthetic amorphous silica comprises 5% or less by weight of the total solid constituents of the core material, the synthetic amorphous silica enhances the flowability of the core material slurry so that it will fill very small passages in a core mold. In addition, the synthetic amorphous silica enhances the strength of the core after the first firing to reduce core breakage during handling of the core between firings.

The synthetic amorphous silica also enables core shrinkage to be more easily controlled. Thus, if the core does not have the desired dimensions due to shrinkage during firing of the core, the amount of synthetic amorphous silica in the core material slurry can be varied to vary the amount of shrinkage and thereby obtain the desired core size. The amount of core shrinkage varies directly with the percentage of synthetic amorphous silica in the core material slurry.

Having described one specific preferred embodiment of the invention, the following is claimed:

1. A material for use in forming cores to be used in casting an article, said core material comprising fused silica, synthetic amorphous silica, a refractory material, and a binder, said synthetic amorphous silica having a surface area of at least 200 square meters per gram.

2. A core material as set forth in claim 1 wherein said synthetic amorphous silica is 5% or less of the total weight of the solid constituents of the core material.

3. A material as set forth in claim 1 wherein said synthetic amorphous silica has a particle size of less than 10 microns.

4. A core material as set forth in claim 3 wherein said fused silica has a particle size of approximately 80 microns.

5. A core material as set forth in claim 1 wherein said material includes 7 to 11 ml. of binder for every ounce of fused silica, synthetic amorphous silica and refractory material.

6. A method of forming cores of a predetermined size and configuration for use in investment casting of articles, said method comprising the steps of providing a core material slurry containing fused silica, synthetic amorphous silica having a surface of more than 200 square meters per gram, refractory material and a binder, providing a core mold having a cavity of a size and configuration which is a function of the desired core size and configuration of the core, shaping a first portion of the core material slurry in the core mold to form a first green core, firing the first green core to form a first fired core, said step of firing the first green core including the step of allowing the material of the first green core to shrink by a first amount, measuring the first fired core to determine the extent to which its size deviates from the desired size, compensating for deviations in the size of the first fired core from the desired size by varying the percentage of synthetic amorphous silica in the core material, shaping a second portion of the core material slurry in the core mold to form a second green core after having performed said step of varying the percentage of synthetic amorphous silica in the core material slurry, and firing the second green core to form a second fired core.

7. A method as set forth in claim 6 wherein said step of providing a core material slurry includes the step of providing a core material slurry in which the synthetic amorphous silica is 5% or less by weight of the total solid constituents of the slurry.

8. A core for use in casting an article, said core being formed of fused silica, a refractory material, a binder, and synthetic amorphous silica having a surface area of at least 200 square meters per gram.

9. A core as set forth in claim 8 wherein said synthetic amorphous silica comprises 5% or less of the total weight of the solid constituents of the core.

* * * * *